US008064788B2

(12) United States Patent
Zaretsky et al.

(10) Patent No.: US 8,064,788 B2
(45) Date of Patent: Nov. 22, 2011

(54) SELECTIVE PRINTING OF RAISED INFORMATION USING ELECTROGRAPHY

(75) Inventors: Mark C. Zaretsky, Rochester, NY (US); Thomas N. Tombs, Rochester, NY (US); William J. Hagen, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 432 days.

(21) Appl. No.: 12/404,485

(22) Filed: Mar. 16, 2009

(65) Prior Publication Data

US 2010/0232821 A1 Sep. 16, 2010

(51) Int. Cl.
*G03G 15/20* (2006.01)

(52) U.S. Cl. ..... 399/67

(58) Field of Classification Search ..... 399/67, 399/222, 302; 430/110.1, 110.4
See application file for complete search history.

(56) References Cited

U.S. PATENT DOCUMENTS

| | | | | |
|---|---|---|---|---|
| 4,871,408 | A * | 10/1989 | Honma et al. | 156/83 |
| 5,563,694 | A | 10/1996 | Katayama | |
| 6,678,493 | B2 * | 1/2004 | Maeyama et al. | 399/302 |
| 7,583,906 | B2 * | 9/2009 | Bessho | 399/30 |
| 7,642,023 | B2 * | 1/2010 | Nagase et al. | 430/45.4 |
| 2004/0037583 | A1 * | 2/2004 | Machida | 399/100 |
| 2008/0159786 | A1 | 7/2008 | Tombs et al. | |
| 2009/0016776 | A1 | 1/2009 | Priebe et al. | |
| 2009/0291274 | A1 * | 11/2009 | Tyagi et al. | 428/207 |
| 2010/0104336 | A1 * | 4/2010 | Christopher et al. | 399/341 |

FOREIGN PATENT DOCUMENTS

| | | | |
|---|---|---|---|
| JP | 8 063039 | A | 3/1996 |
| JP | 11 149214 | A | 6/1999 |
| JP | 2004 074422 | A | 3/2004 |
| JP | 2007052068 | A * | 3/2007 |
| JP | 2009037102 | A * | 2/2009 |

* cited by examiner

*Primary Examiner* — Quana M Grainger
(74) *Attorney, Agent, or Firm* — Donna P. Suchy

(57) ABSTRACT

Printing of information with a distinct tactile feel can be accomplished by electrographic techniques. Such electrographic printing includes the steps of forming a desired print image, electrographically, on a receiver member utilizing standard size marking particles; and in areas of the formed print image, forming raised information by printing at least a first raised image and a second raised image. The print and raised images are fixing on the receiver member. The raised images are applied using toner particles having diameters substantially larger than the diameters standard size toner particles used for applying the print image.

32 Claims, 6 Drawing Sheets

SELECTIVE PRINTING OF RAISED INFORMATION USING ELECTROGRAPHY

FIELD OF THE INVENTION

This invention relates in general to printing and in particular to raised printing to generate a tactile feel using electrographic methods.

BACKGROUND OF THE INVENTION

One common method for printing images on a receiver member is referred to as electrography. In a particular implementation of this method, known as electrophotography, an electrostatic image is formed on a dielectric member by uniformly charging the dielectric member and then discharging selected areas of the uniform charge to yield an image-wise electrostatic charge pattern. Such discharge is typically accomplished by exposing the uniformly charged dielectric member to actinic radiation provided by selectively activating particular light sources in an LED array or a laser device directed at the dielectric member. After the image-wise charge pattern is formed, the pigmented (or in some instances, non-pigmented) toner particles are given a charge, substantially opposite the charge pattern on the dielectric member and brought into the vicinity of the dielectric member so as to be attracted to the image-wise charge pattern to develop such pattern into a visible image.

Thereafter, a suitable receiver member, sometimes simply referred to as a receiver, (e.g., a cut sheet of plain bond paper) or an intermediate transfer member, sometimes simply referred to as an intermediate, (e.g. a compliant or non-compliant roller or web) is brought into juxtaposition with the marking particle developed image-wise charge pattern on the dielectric member. A suitable electric field is applied to transfer the marking particles to the receiver member in the image-wise pattern to form the desired print image on the receiver or intermediate transfer member. In the case of an intermediate transfer member, a secondary transfer step is performed whereby a second suitable electric field is applied to transfer the marking particles from the intermediate receiver member to the receiver member. The receiver member is then removed from its operative association with the dielectric member and the marking particle print image is permanently fixed to the receiver member typically using heat, and/or pressure. Multiple layers or marking materials can be overlaid on one receiver, for example layers of different color particles can be overlaid on one receiver member to form a multi-color print image on the receiver member after fixing.

In the earlier days of electrographic printing, the marking particles were relatively large (e.g., on the order of 10-15 μm). As a result the print image had a tendency to exhibit a relief (variably raised surface) appearance. Under most circumstances, the relief appearance was considered an objectionable artifact in the print image. In order to improve image quality, and to reduce relief appearance, over the years, smaller marking particles (e.g., on the order of less than 8 μm) have been formulated and are more commonly used today.

SUMMARY OF THE INVENTION

With the improved print image quality, print providers and customers alike have been looking at ways to expand the use of electrographically produced prints. In certain classes of printing, a tactile feel to the print is considered to be highly desirable. Specifically, ultra-high quality printing, such as printing for stationary headers or business cards, utilizes raised letter printing to give a tactile feel to the resultant print output. For many of these printing applications, in order to directly replace the standard, and more expensive, engraving, embossing, or thermographic processes, it is highly desirable to produce a raised letter height of 50 μm or greater. Some other instances where tactile feel in the print would be desirable are Braille prints or print documents having security features provided there within. Presently, the minimum height recommended for Braille prints is 200 μm.

U.S. Patent Application Publication No. 2008/0159786 describes the use of a fifth color module in an electrophotographic printing process for depositing a high mass laydown ($\geqq$2 mg/cm$^2$) of a large clear toner particle alongside standard, smaller sized, pigmented toner particles for producing a high quality print having tactile feel. However, due to limitations on: 1) toner size due to the manufacturing process—typical processes limit toner size average diameter to roughly 30 μm, and 2) the development step in the electrophotographic process—limiting the mass laydown to roughly a double layer of clear toner, the maximum raised letter height for a rich black text at 320% laydown for 8 μm pigmented toner plus the large clear toner is less than 40 μm. This falls short of the 50 μm height desired for directly replacing thermographically produced prints and falls far short of the 200 μm recommended height for Braille prints. In addition, achieving a ground toner size of 30 μm or greater creates significant manufacturing challenges and costs: 1) changing to a non-standard air nozzle for grinding—manufacturing inefficiency, and 2) extra size classifying step—significantly lower manufacturing yield.

Accordingly, the invention is directed to an electrographic printing of raised images to selected areas of a receiver member using electrographic techniques so that resulting image made from two different sized toner particles has a raised print height of 40 μm and greater.

In view of the above, an electrographic printing method for forming raised information on a receiver member includes forming a print image electrographically on a receiver member using standard sized marking particles; forming a first raised image electrographically on first selected areas of the print image on the receiver member using non-marking particles substantially larger than the standard sized marking particles; and forming a second raised image electrographically on second selected areas of the first raised image and the print image using non-marking particles substantially larger than the standard sized marking particles.

DETAILED DESCRIPTION OF THE INVENTION

Figure 1:
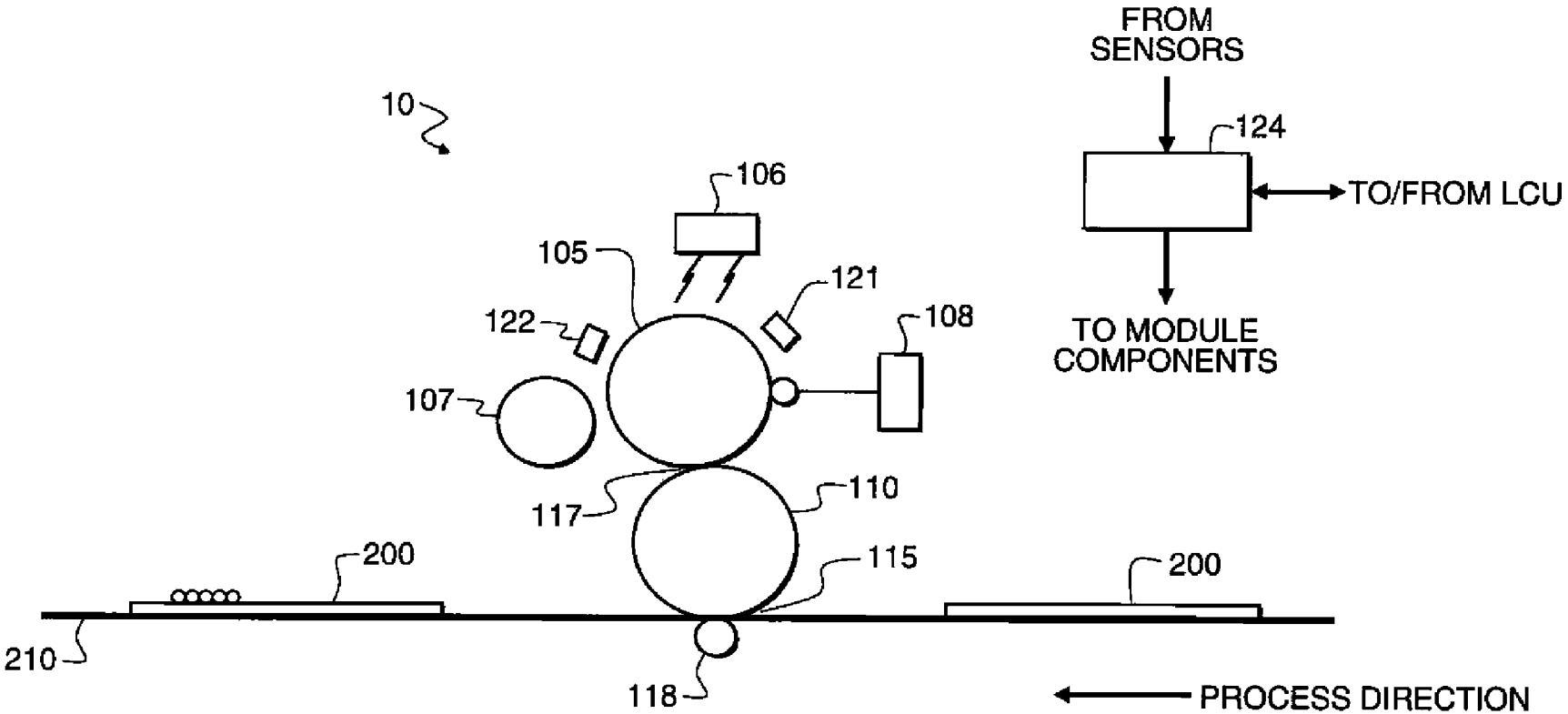
FIG. 1 is a schematic diagram illustrating an electrographic printing module for use with the present invention.
Figure 2:
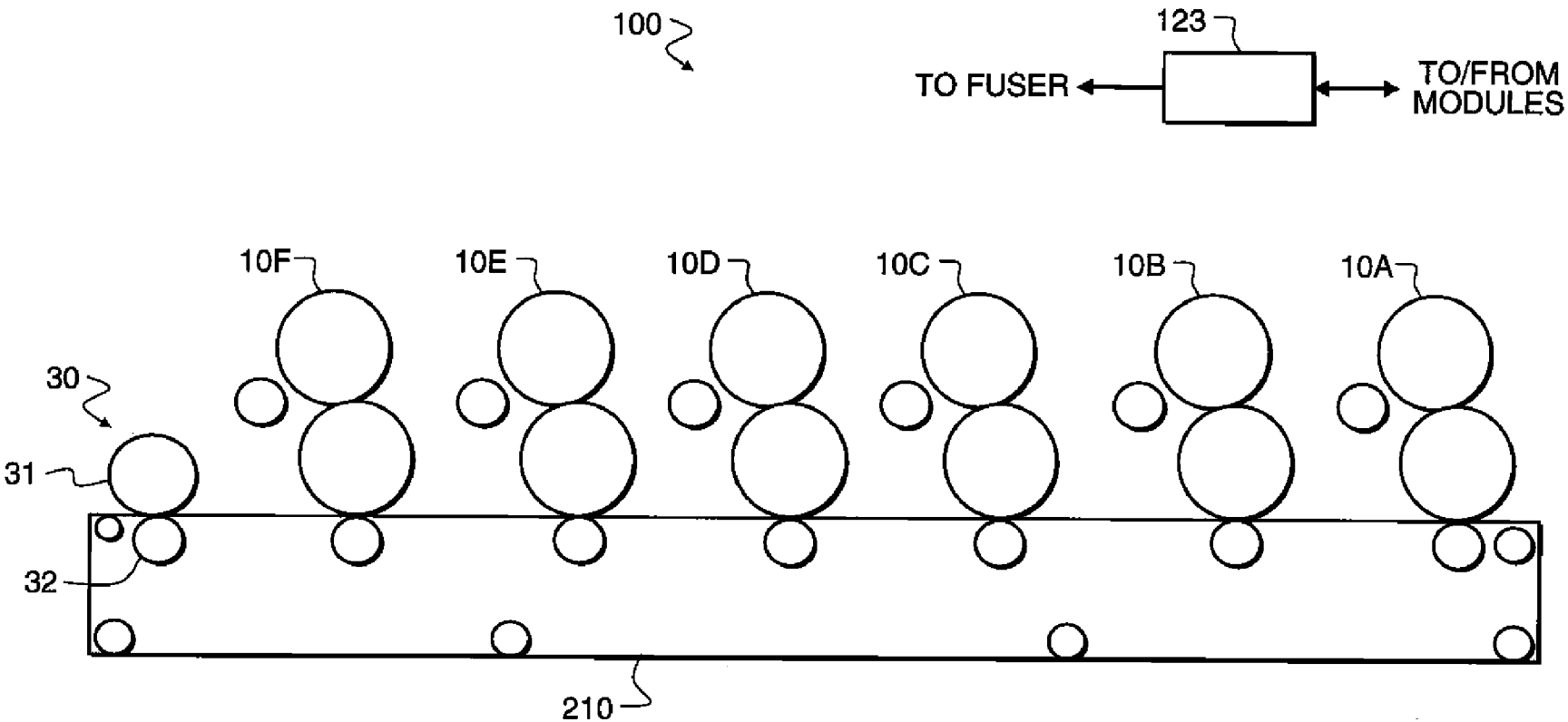
FIG. 2 is a schematic diagram illustrating an electrographic printing engine employing printing modules as illustrated in FIG. 1 for use with the present invention.

Referring now to the accompanying drawings, FIGS. 1 and 2 schematically illustrate an electrographic printer engine according to embodiments of the current invention. Although the illustrated embodiment of the invention involves an electrographic apparatus employing six image producing print modules arranged therein for printing onto individual receiver members, the invention can be employed with either fewer or more than six modules. The invention may be practiced with other types of electrographic modules.

The electrographic printer engine 100 has a series of electrographic printing modules 10A, 10B, 10C, 10D, 10E, and 10F. As discussed below, each of the printing modules forms an electrostatic image, employs a developer having a carrier and toner particles to develop the electrostatic image, and transfers a developed image to a receiver member 200. Where the toner particles of the developer are pigmented, the toner particles are also referred to as "marking particles." The receiver member may be a sheet of paper, cardboard, plastic, or other material to which it is desired to print an image or a predefined pattern.

The electrographic printing module 10 shown in FIG. 1 is representative of each of the electrographic printing modules 10A-10F of the electrographic printing engine 100 shown in FIG. 2. The electrographic printing module 10 includes a plurality of electrophotographic imaging subsystems for producing one or more multilayered image or shape. Included in each printing module is a primary charging subsystem 108 for uniformly electrostatically charging a surface of a photoconductive imaging member (shown in the form of an imaging cylinder 105). An exposure subsystem 106 is provided for image-wise modulating the uniform electrostatic charge by exposing the photoconductive imaging member to form a latent electrostatic multi-layer (separation) image of the respective layers. A development station subsystem 107 is provided developing the image-wise exposed photoconductive imaging member. An intermediate transfer member 110 is provided for transferring the respective layer (separation) image from the photoconductive imaging member through a first transfer nip 117 to the surface of the intermediate transfer member 110 and from the intermediate transfer member 110 through a second transfer nip 115 to a receiver member 200.

The electrographic printing engine illustrated in FIG. 2 employs six electrostatic printer modules 10A, 10B, 10C, 10D, 10E, and 10F each of which has the structure of the electrostatic printer module 10 illustrated in FIG. 1. Each of the printing modules is capable of applying a single color, transferable image to receiver members 200. The transport belt 210 transports the receiver member 200 for processing by the printing engine 100. As the receiver member 200 moves sequentially through the printing nips of the electrostatic printer modules 10A, 10B, 10C, 10D, 10E, and 10F, the printing modules successively transfer the generated, developed images onto the receiving member in a single pass.

The illustrated printing engine 100 includes six electrostatic printing modules, and accordingly up to six images can be formed on a receiver member in one pass. For example, printing modules 10A, 10B, 10C, and 10D can be driven with image information to form black, yellow, magenta, and cyan, images, respectively. As is known in the art, a spectrum of colors can be produced by combining the primary colors cyan, magenta, yellow, and black, and subsets thereof in various combinations. The developer employed in the development station of printing modules 10A, 10B, 10C, and 10D would employ pigmented marking particles of the respective color corresponding to the color of the image to be applied by a respective printing module. The remaining two modules, 10E and 10F, can be provided with marking particles having alternate colors to provide improved color gamut, non-pigmented particles to provide clear layer protection or raised print capability, or some combination thereof. For example, the fifth electrostatic module can be provided with developer having red pigmented marking particles and the sixth electrostatic module can be provided with developer having larger sized non-pigmented particles.

Following the completion of the transfer step by a plurality of the electrostatic printing modules 10A-10F in sequence for a given receiver member, a fusing step is performed on the receiver member to fuse the multi-color developed image to the receiver member. The fusing step provides heat and/or pressure to the receiver member.

For example, the transport belt 210 can move the receiver member 200 with the multi-colored image to fusing assembly 30. Fusing assembly 30 includes a heated fusing roller 31 and an opposing pressure roller 32 that form a fusing nip therebetween to apply heat and pressure to a receiver member 200. The fusing assembly may also apply fusing oil such as silicone oil to the fusing roller 31 depending on the application. Additional details of the developing and fusing process are described in U.S. Publication No. 2008/0159786, published Jul. 3, 2008 in the names of Thomas N. Tombs, et al. which is herein incorporated by reference.

In the example shown, the same transport belt 210 is used for transferring the receiver members 200 through the printing modules and for moving the receiver members 200 through the fusing step so that the process speed for fusing and the process speed for applying raised and print images are the same. The invention is not limited to practice with a single process speed, and separate transport mechanisms can be provided for applying images and fusing images allowing the image applying and fusing process speeds to be set independently.

The printing engine 100 includes a logic and control unit 123 that includes one or more computers and in response to signals from various sensors associated with the electrographic printer engine 100, provides timing and control signals to the respective components to provide control of the various components and process control parameters of the apparatus in accordance with well understood and known employments. The logic and control unit 123 may contain individual logic and control components 124 for each of the printing modules 10A, 10B, 10C, 10D, 10E, and 10F.

For the purpose of providing selective printing of raised printed information using an electrographic printing apparatus, for example for the purpose of generating a tactile feel, printed images can be generated using one or more of printing modules of the print engine with pigmented marking particles, and selected electrostatic printing modules of the printing engine can be provided with non-pigmented, non-marking particles (e.g. clear toner). By printing non-marking particles on top of a print image formed using marking particles, raised print information, for example raised lettering can be applied to a receiver member.

The term particle size, as used herein to refer to developer particles including the carrier, marking and non-marking particles means the mean volume weighted diameter as measured by conventional diameter measuring devices, such as a Coulter Multisizer, sold by Coulter, Inc. The mean volume weighted diameter is the sum of the mass of each particle times the diameter of a spherical particle of equal mass and density, divided by total particle mass.

The principle employed in providing tactile feel is to achieve a post fusing stack height of at least 20 μm on a receiver member. However, 40 to 50 μm and greater stack heights are often desirable for some applications, and in some cases even greater stack heights including heights of 100 μm and more are required.

With a typical electrographic printing module, developing steps using two component developer systems are limited to applying two layers of toner particles due to counter charge issues. The resulting stack height after fusing a single layer of 8 μm marking particles is about 4 μm. Building up the stack height could be accomplished by using several printing modules to build up layers of toner particles. But increasing the stack height using standard sized particles would limit the number of printing modules available for depositing pigmented color modules. Accordingly, particles substantially larger than 8 μm are employed to provide raised printing having post fusion stack heights greater than 20 μm.

Techniques for employing developers having toner particles of greater than 20 μm can be used to provide raised printing. Typically electrographic printing modules employing such particles can apply two layers per module whereby the 2 layers of 20 μm particles produce a post fusing stack height of about 20 μm.

According to principles of the present invention, a print image can be transferred to a receiver member using one or more of the available electrographic print modules in a single pass. To form a print image having the highest quality, the print image can be formed using a layer of small, pigmented marking particles having a standard, general volume average diameter of less than 9 μm.

The print image can be a multi-colored print image formed by using a plurality of electrographic print modules. Referring to FIG. 2, by using electrographic print engine 100, electrographic print module 10A can form yellow (Y) toner separation images, electrographic print module 10B can form magenta (M) toner separation images, 10C can form cyan (C) toner separation images, while 10D can form black (K) toner separation images. While the use of C, Y, M, and K images allows generation of a print image having a spectrum of colors the invention may be practiced using other colors.

The electrographic printing modules 10A, 10B, 10C, and 10D are controlled using electrographic process-set points, control parameters, and algorithms appropriate for the developer for printing using the marking particles and carrier particles of the print image. The set-points, control parameters, and algorithms can be implemented in logic forming part of the logic and control unit 123.

After electrographic printing modules 10A, 10B, 10C, and 10D have been used to deliver the multi-color portion of the print image to the receiver member 200, a plurality of remaining modules can be used to form raised images on selected areas of the receiver member 200. By employing multiple printing modules to apply raised images to the receiver member in a single pass, a final stack height can be obtained for providing the required tactile feel.

Figure 3:
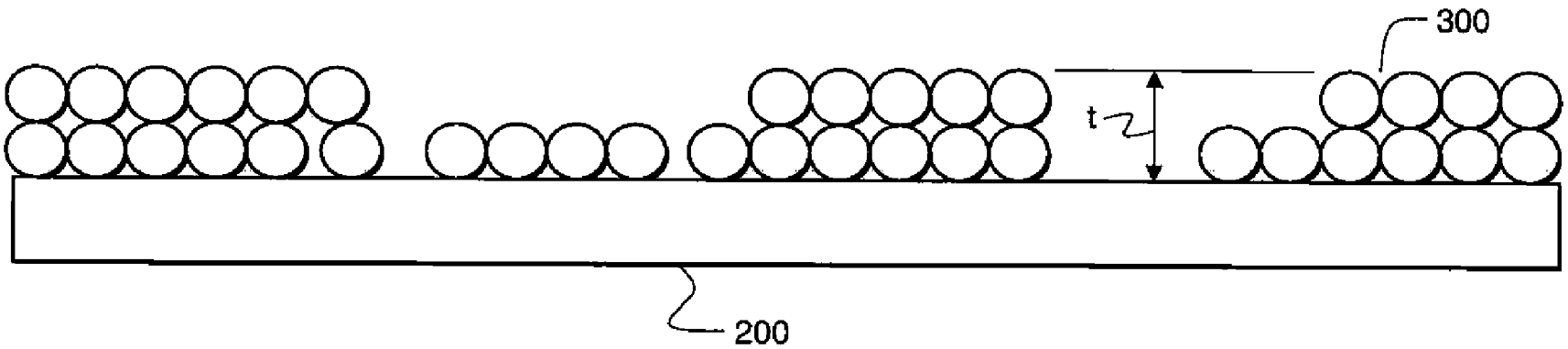
FIG. 3 is a schematic side view illustrating a cross section of a receiver member having a print image formed thereon.

FIG. 3 shows a receiver member 200 having a print image 300 formed using print modules 10A, 10B, 10C, and 10D. As shown in FIG. 3, the print image has a stack height "t." Where 8 μm marking particles are used, the print image stack height can be between 4 and 8 μm after the fusing process.

The development stations for electrographic printing modules 10E and 10F supply developer that includes carrier particles and non-pigmented non-marking particles. The non-marking particles used in forming the raised images are substantially larger in size than the standard sized marking particles used in forming the print image. For example, the volume average diameter of the non-pigmented toner particles may be between greater than 14 μm, and preferably between 20 and 50 μm, and more preferably between 20 and 30 μm.

Additionally, it has been found that when printing raised images using hard ferrite carrier particles having diameters similar to the non-marking particles (e.g. 20 to 23 μm carrier particles in combination with 20 μm toner particles), the carrier particles tended to develop along with the toner in an image-wise fashion. On the other hand, when very large carrier particles were used, the image wise carry-out of carrier particles is avoided, but unacceptable dusting of the toner occurred due to low charging of the toner against the reduced surface area of the larger carrier particles. For example, acceptable performance was achieved using a developer having the following distribution of carrier and non-marking particle sizes:

a) non-marking toner particle size is larger than 18 μm volume average diameter and preferably between 20 and 0 μm and more preferably between 20 and 30 μm volume average diameter;

b) carrier particle size is larger than the toner particle size employed and ranges between 25 and 60 μm;

c) difference between the volume average diameter for carrier and toner particles used is greater than 5 μm or the ratio of carrier-to-toner volume average diameter exceeds 1.25; and d) the overlap in the volume average distribution of toner and carrier particle size is less than 35%.

According to principles of the present invention, the process for printing the raised information includes forming a sequence of two or more raised images in selected areas of the receiver member.

Figure 4:
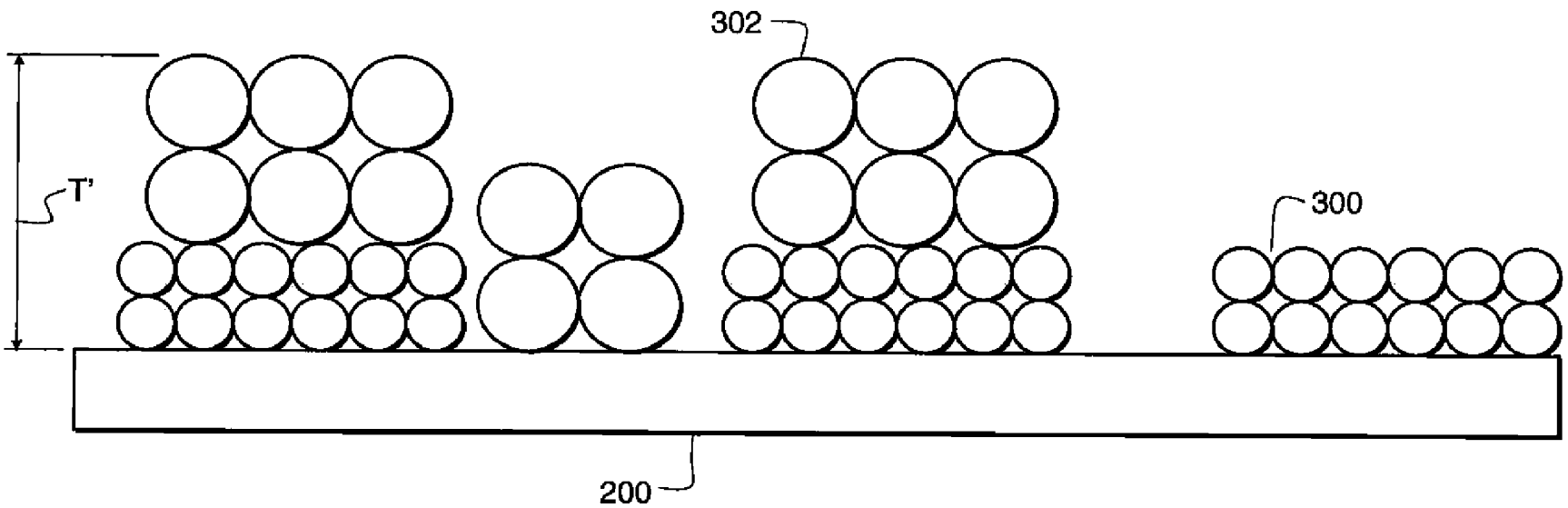
FIG. 4 is a schematic side view illustrating a cross section of a receiver member having a first raised image formed thereon.

Using printing module 10E, the printing engine 100 forms a first raised image. Referring to FIG. 4, it may be appreciated that the first raised image 302 is formed in selected areas of the receiver member 200 on which the printed image 300 has been formed. The selected areas for forming the first raised image 302 can include areas that overlap areas having marking particles from the print image 300, but can also be formed in areas where no marking particles for the first print image are disposed.

Figure 5:
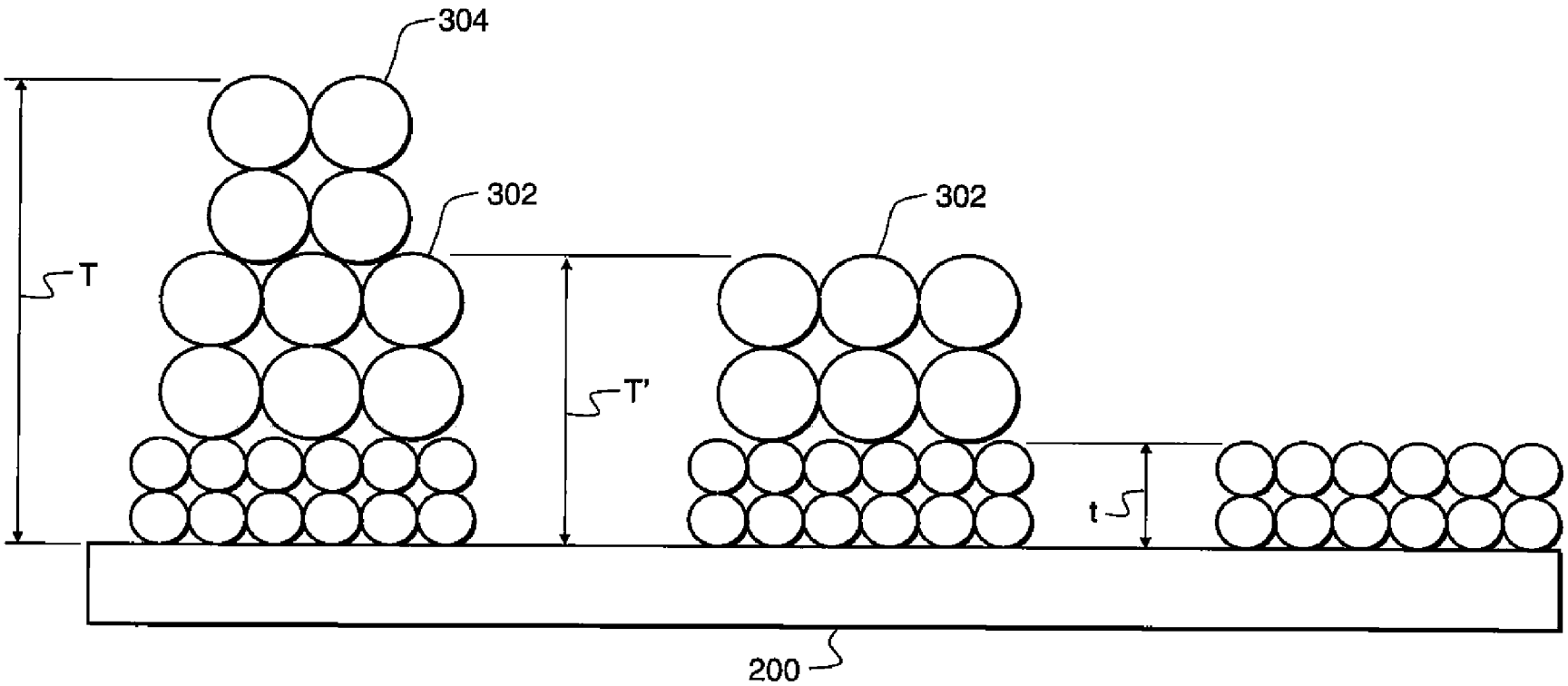
FIG. 5 is a schematic side view illustrating a cross section of a receiver member having a second raised image formed thereon.

Next, the printing engine 100 forms a second raised image using printing module 10F. Referring to FIG. 5, it may be appreciated that the second raised image 304 is formed in second selected areas of the receiver member 200 on which the printed image 300 and the first raised image has been formed. The second selected areas for forming the second raised image 304 can include areas that overlap areas having marking particles from the first raised print image 302, but can also be formed in areas of the receiver member where no marking particles for the first print image are present and areas in which no marking particles for the first raised image are present.

Where the second raised image 304 overlaps with the first raised image 302 and the print image, a desired stack height T for achieving the desired tactile feel can be obtained, whereas in those areas where only one of the first and second raised images is applied, a lesser stack height T' is obtained. Using the larger non-marking particles for generating the larger portion of the desired stack height achieves larger stack heights while reserving an adequate number of printing modules for applying a print image. Further, using the smaller marking particles for applying the print image allows a high quality print image even when clear, raised, images are printed on the print image. In addition, using small size marking particles for image areas where the raised effect is not needed and large non-marking particles for areas where the raised effect is desired enables the ability to simultaneously produce a raised image and a non-raised image. Finally, the use of small size marking particles for image areas where the raised effect is not needed minimizes the cost of producing the print since less mass is required when smaller marking particles are utilized.

In other embodiments of the invention, a multi-colored print image may be applied to the print receiver using fewer than four print modules. Referring to FIG. 2, electrographic print module 10A can form yellow (Y) toner separation images, electrographic print module 10B can form magenta (M) toner separation images, while 10C can form a cyan (C) toner separation images. When printing a multi-colored image using yellow, magenta, and cyan, images, black color may be generated by applying equal amounts of yellow, magenta, and cyan in the desired area of the print image. In this case, three printing modules, namely, modules 10D, 10E, and 10F are available for forming raised images on selected areas of the receiver.

In yet another embodiment, a single print module can apply a monochromatic or gray scale print image to the receiver member using standard sized marking particles. For example, using a single print module of print engine 100 to apply a monochromatic print image reserves five modules for applying raised images.

For example, after the printing engine 100 forms a single color print image on the receiver member 200 using print module 10A, a plurality of the remaining modules are available for forming raised images on the receiver member 200. Using the print engine illustrated in FIG. 2, two, three, four, or five raised images may be formed in succession on a receiver member using two or more of printing modules 10B, 10C, 10D, 10E, and 10F, enabling raised post fusing print heights well in excess of 100 μm.

Image data for writing by the printer apparatus 100 may be processed by a raster image processor (RIP), which may include a color separation screen generator or generators. The output of the RIP may be stored in frame or line buffers for transmission of the color separation print data to the exposure units of each of the respective print modules used for applying the print image. The RIP and/or color separation screen generator may be a part of the printer apparatus or remote therefrom. Image data processed by the RIP may be obtained from a color document scanner or a digital camera or generated by a computer or from a memory or network which typically includes image data representing a continuous image that needs to be reprocessed into halftone image data in order to be adequately represented by the printer. The RIP may perform image processing processes including color correction, etc. in order to obtain the desired color print. Color image data is separated into the respective colors and converted by the RIP to halftone dot image data in the respective color using matrices, which comprise desired screen angles and screen rulings. The RIP may be a suitably programmed computer and/or logic devices and is adapted to employ stored or generated matrices and templates for processing separated color image data into rendered image data in the form of halftone information suitable for printing.

In areas where one or more raised images overlap a colored print image, the apparent color of the print image as viewed through the raised image may change. In order to produce a finished printed product in which colors appear consistently across a receiver member, the algorithm for generating the color separation include a color profile that generates a different color separation in areas where the print image is overlapped by a raised image than in areas where the print image is not overlapped by a raised image. In one embodiment, two color profiles are created. The first color profile is for 100% clear or non-pigmented toner coverage on top, and the second color profile is for 0% clear toner coverage on top. On a pixel by pixel basis, proportional to the amount of coverage called for in the clear toner image plane, a third color profile is created, and this third color profile interpolates the values of the first and second color profiles. Thus, a blending operation of the two color profiles is used to create printing values. In a preferred embodiment, a linear interpolation of the two color profile values corresponding to a particular pixel is performed. It is understood, however, that some form of nonlinear interpolation may be used instead.

A clear toner overcoat can be provided in areas of the receiver member where raised printing is not desired. One method of enhancing fusing is to provide good adhesion to a receiver member when there is a large variation in toner mass laydown on a receiver member. The described method includes the steps of forming multicolor toner images, determining the amount of clear overcoat mass laydown (OML) as a function of the color mass laydown (CML) or non-raised mass laydown (NRML) of one or more layers of color toner, and fusing the clear toner overcoat and the multicolor toner image at a fusing temperature determined by the maximum total mass laydown (TML) and the nip width to provide good adhesion to the receiver member while optimizing fuser offset latitude. It has been found that the deposition of a significantly less than 100% coverage of clear toner in the non-raised image areas, defined as the OML and significantly less than 2.0 mg/cm$^2$, can serve as a protective overcoat layer, pushing the hot offset failure to a higher temperature, thereby enhancing the fuser offset latitude and enabling the use of a high mass laydown of toner for a raised print application in all circumstances, for example when one or more receivers are of a dense or coated paper, which does not readily absorb oil. Essentially, the total toner mass laydown of the non-raised regions (the sum of the NRML and OML) is increased so as to avoid excessive heating and cohesive failure. Preferably, this coverage is in the range of 0% to 60%, the exact coverage depending upon the mass laydown of the non-clear toner (NRML) as well as other factors describing the fuser subsystem, the toner materials, and the receiver member. Note that in general the mass laydown per area of the protective overcoat layer (OML) is non-linear with % coverage, such that 50% coverage will be noticeably less than ½ of the mass laydown associated with 100% coverage. Another benefit of this protective layer is the reduction of the color shift observed between raised and non-raised image areas. The low coverage of clear toner in the non-raised image areas is still sufficient to reduce the toner flow in fusing, thereby resulting in more similar color shifts as observed in the raised image areas, the color shift being measured relative to a CMYK toner laydown without any protective layer.

The image data for printing the raised images may be developed in a number of ways. In one embodiment, the raised image data can be generated from the print image information to correspond to certain types of objects in the print image. For example, the raised image data may be generated to correspond to a text object so that the text object will be printed with raised printing. In this case a digital front end for the print module will generate data for driving the exposure units of the plurality of print modules used for applying the correspondingly numbered raised images to the receiver member.

In another embodiment, the raised image is applied to completely overlap the print image. In that case, data for the raised image information is again derived from the color or mono-chrome data for printing the print image, but is computed such that the raised image is applied in the entire area for applying the print image. For example, where a CYMK print image is applied, the raised information is generated to have a value for any pixel or area in which either a C, Y, M, or K image information as a non-zero value.

In another embodiment, the raised data may be retrieved from a suitable database containing a pattern to enable the variable data printing of tactile images wherein the background texture may, for example, provide the impression of a painter's canvas, an acrylic painting, a basketball (pigskin), sandstone, sandpaper, cloth, carpet, parchment, skin, fur, or wood grain. The locations for applying the pattern can also be specified independently of the data for the print image so the texture may be applied in specific areas of the receiver members.

Although specific modules were described as providing the print image and the raised images in the examples below, the invention is not limited to being practiced in this manner. For example, the selected areas for applying the raised images may not overlap any areas for applying the print image. As another example, it may be desired to display a tactile image in portions of the receiver member that do not include the print image. In such a case, any sequence of modules can be used for applying the print image and the raised image.

On the other hand, in applications requiring raised printing such as raised text, a print image is applied to the receiver member in the areas requiring raised printing prior to applying the raised images. When applying the raised printing in a single pass, the modules selected for applying the raised printing are chosen to apply clear toner following the application of the print image.

Further, although the invention is described herein using an example printing engine having six print modules, the number of print modules is exemplary and the invention may be practiced with an apparatus having a different number of print modules.

Additionally, the developer for applying the raised images has been described as applying non-marking particles which are not pigmented. In an alternative embodiment, the developer for applying the raised images may contain pigmented toner particles having a size substantially larger than the marking particles for applying the print image.

When printing the raised images using a substantially larger size marking particle in a plurality of electrographic modules it may be advantageous to alter one or more electrographic process set-points, or operating algorithms, to optimize performance, reliability, and/or image quality of the resultant print. Examples of electrographic processes set-point (or operating algorithms) values that may be controlled in the electrographic printer to alternate predetermined values when printing raised information include, for example: fusing temperature, fusing nip width, fusing nip pressure, imaging voltage on the photoconductive member, toning station transfer voltage, image transfer voltage and image transfer current, and the amount of fusing oil applied during the fusing process. In an electrographic apparatus that makes raised information prints, a special mode of operation may be provided where the predetermined set-points (or control parameters or algorithms) are used when printing the raised information. That is, when the electrographic printing apparatus prints non-raised information images, a first set of set-points/control parameters are utilized. Then, when the electrographic printing apparatus changes mode to print raised information images, a second set of set-points/control parameters are utilized In an electrographic fusing process, the fused toner does not penetrate substrate fibers of the receiver member, but remains entirely above the paper substrate. The fusing step can reduce the height of the toner lay down by approximately one half. As discussed above, parameters for a fusing process that effectively fixes the toner to the receiver member may vary depending on the number of printer modules used for raised printing and the sizes of the marking particles used in applying the print and raised images, as well as the physical and thermal properties of the receiver member. Additionally, parameters such as the one or more sets of fusing parameters for printing raised information can be stored in a memory associated with the printing engine and can be selected and applied based on parameters such as the type of receiver member, the desired post fusing stack height, fusing process speed, the number of print modules used for applying a print image, the sizes and types of toner particles used for applying raised and print images, and the number of print modules used for applying raised images. The parameters may be input manually by an operator, may be determined automatically by sensors associated with the print modules, or a combination of manual entry and parameter sensing may be employed.

Preferably the marking particles used for printing the raised information have a substantially larger general average mean volume weighted diameter than the particles for applying the print information. For example, the marking particles for printing the print information may have a standard general average mean volume of less than 9 μm (e.g. 8 μm), while the marking particles for printing the raised information may have general average mean volume weighted diameter between 12 and 30 μm (e.g. between 21 and 30 μm).

In an example electrographic print engine according to an embodiment of the invention using 8 μm marking particles for applying the print image information, and using 20 μm particles for printing the raised image information, toner lay down coverage of up to 5 mg/cm$^2$ were achieved in areas where the print image and a first and second raised image were applied resulting in post-fusing stack heights of about 50 μm. By way of contrast, when applying several imaging modules using the 8 μm marking particles, lay down coverage of about 0.4 to 0.5 mg/cm$^2$ is typical for each applied layer. Employing enough printing modules to achieve the desired stack heights using 8 μm particles would severely limit the number of available modules for depositing color toners, reducing the achievable color gamut for the final image.

On the other hand, by employing multiple print modules using large non-marking particles to apply raised print images, increased post-fusing stack heights can be achieved using the available print modules for a printing engine. For example, by using four or five modules to apply raised printing images using the larger, non-marking particles, fixed stack heights of 100 μm and greater are possible using electrographic printing.

In the examples described above, the larger sized toner particles for printing raised images have been described as non-pigmented, non-marking particles. The invention may also be practiced with larger sized pigmented particles being used to provide the raised images. For example, raised text of a particular color may be applied using the apparatus described by replacing one or more of the larger sized non-marking particles with larger sized, pigmented, marking toner particles.

Further, in the examples described above, each module for printing a raised image employed toner particles having the same volume average diameter. The invention is not limited to being practiced in this fashion. The plurality of print modules used for applying raised images may employ toner particles having differing sizes provided that the volume average diameter employed by each of the print modules is substantially larger than the standard sized particles. For example, when applying two raised images to a receiver member, the toner particles for printing the first raised image may be substantially larger than the toner particles for printing the second raised image.

Figure 6:
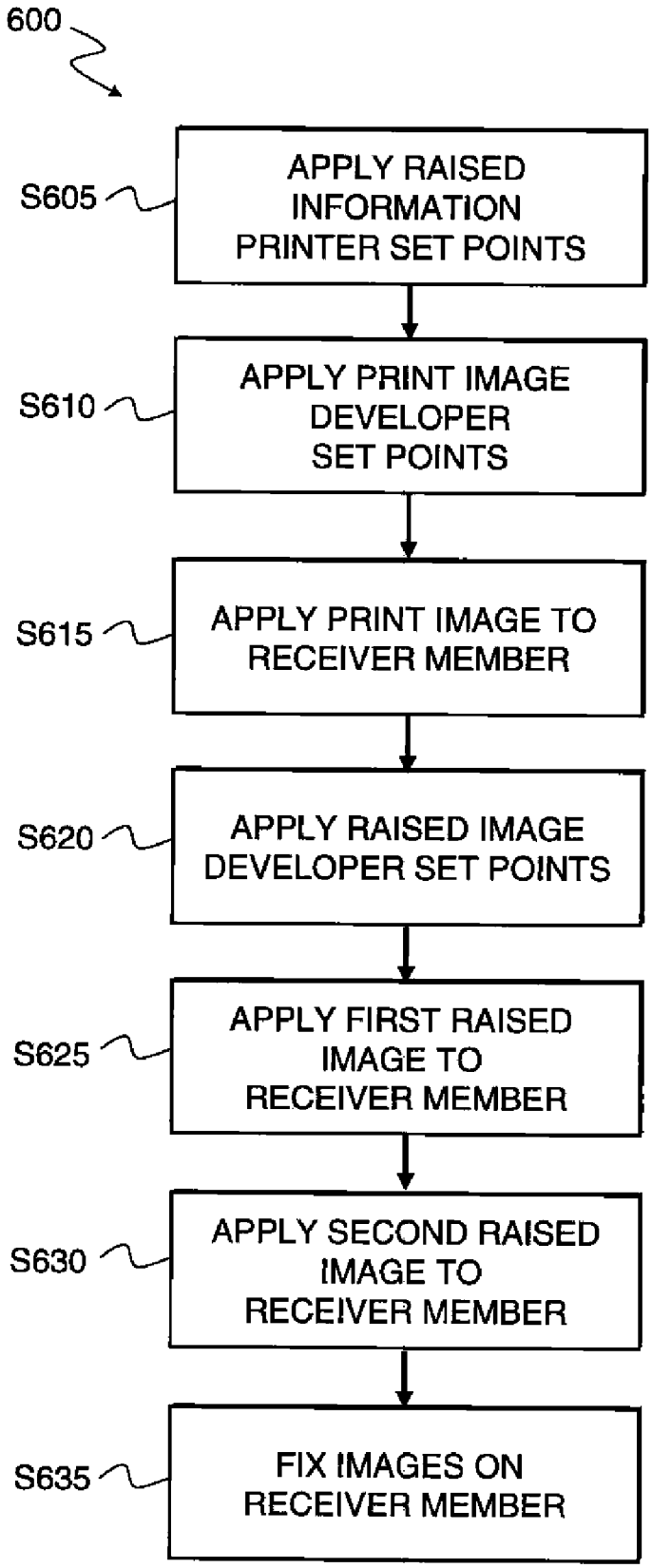
FIG. 6 is a flow chart illustrating a process in accordance with the present invention.

An electrographic printing method for applying raised printing to a receiver member will be described with reference to FIG. 6. The electrographic printing method can be performed using the apparatus illustrated in FIGS. 1 and 2 and can include steps exploiting the capabilities described for the printing apparatus.

The electrographic printing method 600 begins at step S605 in which set points of the electrographic print engine are set up for printing raised information. In particular, and as described above, set points for the fuser may be adjusted so that the printing on the receiver member will be properly fixed. In addition, process speed for moving the receiver members through the print engine may be set differently than for a process in which raised printing will not be applied.

Process 600 continues at step S610 in which parameters and set points for applying the print image are applied. For example, the imaging voltage the toning station transfer voltage, magnetic brush operating parameters, the image transfer voltage and the image transfer current may be set to parameters appropriate for applying developer using standard sized marking particles. These parameters and set points are applied to those modules for applying the print image.

Process 600 continues at step S615 in which the print image is applied to the receiver member. As discussed above, the print image can be a multi-colored image or a monochrome image.

Following the application of the print image, parameters and set points for applying raised images are established at step S620. For example, the imaging voltage, the toning station transfer voltage, magnetic brush operating parameters, the image transfer voltage and the image transfer current may be set to parameters appropriate for applying developer marking particles for applying the raised images. The marking particles for printing the raised images are typically substantially larger than those for printing the print image, and the electrographic parameters and set points are applied to those modules for applying the raised images are typically different those applied to the modules for applying the print image.

For example, the printing engine 100 can form a multi-colored print image on the receiver member 200 using print modules 10B, 10C, 10E, and 10F. Printing module 10A can be used to apply a first raised image using a first larger than standard sized toner particle (e.g. a 20 μm marking particle), and printing module 10E can be used to apply a second raised printing image using a second larger than standard sized toner particle (e.g. a 30 μm marking particle).

Process 600 continues at step S625 in which the first raised image is applied to the receiver member in first selected areas of a receiver member. At step S630, a second raised image is applied in second selected areas of a receiver member. The first selected areas may be the same as the second selected areas. The first selected areas and the second selected areas may overlap with all or some portion of the print image. Alternatively, the print image and the raised images may occupy separate areas of a receiver member.

Following application of the first and second raised image, the print image and the raised images are fused on the receiver member to fix the combined image. Additional process steps can be added to process 600 when more than 6 print modules are used.

The invention has been described in detail with particular reference to certain preferred embodiments thereof, but it will be understood that variations and modifications can be effected within the spirit and scope of the invention.

PARTS LIST

10 electrographic printing modules
30 fusing assembly
31 heated fusing roller
32 Fuser pressure roller
100 electrographic printer engine
105 photoconductive drum
106 exposing unit
107 development station
108 charging module
110 intermediate transfer member drum
115 second transfer nip
117 first transfer nip
118 rotating lower transfer drum
121 uniform electrostatic charge meter
122 post exposure charge meter
123 logic and control unit
124 module logic and control component
200 receiver member
210 transport belt
300 print image
302 first raised image
304 second raised image

The invention claimed is:

1. An electrographic printing method for forming raised information on a receiver member, the method comprising:

forming a print image electrographically on a receiver member using standard sized marking particles;

forming a first raised image electrographically on first selected areas of the print image on the receiver member using first toner particles having a volume average diameter substantially larger than the standard sized marking particles;

forming a second raised image electrographically on second selected areas of the first raised image and the print image using second toner particles having a volume average diameter substantially larger than the standard sized marking particles; and setting a process parameter for fixing the print image and the raised images to the receiver member to a changed value distinct from a value for fixing a print image without the raised images, and fixing the print image and the raised images to the receiver member using a fuser employing the changed parameter value.

2. The method according to claim 1, wherein a volume average diameter of the first toner particles for forming the first raised image is substantially larger than a volume average diameter of the second toner particles for printing the second raised image.

3. The method according to claim 1, wherein the first toner particles for applying the first raised image and the second toner particles for applying the second raised image are non-marking particles.

4. The method according to claim 1, wherein the first selected areas and the second selected areas overlap the print image on a portion of the receiver member, and wherein the total fused height of a marking particle and larger sized toner particle stack is at least 40 μm on the portion of the receiver member.

5. The method according to claim 1, wherein the standard size marking particles have a volume average diameter of less than 9 μm, and the toner particles for printing the first raised image and for printing the second raised image have a volume average diameter of greater than 14 μm.

6. The method according to claim 1, wherein the first selected areas and the second selected areas overlap the print image on a portion of the receiver member, and wherein the total fused height of a marking particle and larger sized toner particle stack is at least 100 μm on the portion of the receiver member.

7. The method according to claim 1, wherein forming a print image electrographically on a receiver member comprises forming a print image using a plurality of print modules, wherein each print module applies a pigmented marking particle have a color different from the marking particles applied by the others of the print modules.

8. The method according to claim 1, wherein the toner particles for applying at least one of the first raised images and the second raised images are pigmented marking toner particles.

9. The method according to claim 1, wherein forming a print image electrographically on a receiver member comprises forming a print image using a single print module.

10. The method according to claim 1, wherein one or more electrographic process set points for a print module applying a print image to a receiver member is different from one or more corresponding electrographic process set points for a print module applying the first raised image to the receiver member.

11. The method according to claim 1, wherein an algorithm for generating image information for applying the print image in an area of the receiver member overlapped by at least one of the first raised image and the second raised image is different from an algorithm for generating image information for generating the print image in an area of the receiver member not overlapped by the first raised image and not overlapped by the second raised image.

12. The method according to claim 1, further comprising:

forming a third raised image electrographically on third selected areas of the print image on the receiver member using third toner particles having a volume average diameter substantially larger than volume average diameter of the standard sized marking particles.

13. An electrographic printing method for forming raised information, the method comprising:

receiving a receiver member;

selectively applying first standard size marling particles onto the receiving member by a first print module;

selectively applying first larger sized toner particles having a volume average diameter substantially larger than the standard size marking particles onto the receiving member by a second print module;

selectively applying second larger sized toner particles having a volume average diameter substantially larger than the standard size marking particles onto the receiving member by a third print module; and setting a process parameter for fixing the print image and the raised images to the receiver member to a changed value distinct from a value for fixing a print image without the raised images, and fixing the print image and the raised images to the receiver member using a fuser employing the changed parameter value.

14. The method according to claim 13, wherein the standard size marking particles have a volume average diameter of less than 9 μm, and the first and second larger sized toner particles have a volume average diameter of greater than 14 μm.

15. The method according to claim 13, wherein the first larger sized toner particles are applied on the first standard size marking particles on a portion of the receiver member, and the second selected larger sized toner particles are applied on the first larger sized marking particles applied on the first standard sized marking particles on the portion of the receiver member to form a marking particle and larger sized toning particle stack, and wherein a total fused height of a marking particle and larger sized toner particle stack is at least 40 μm on at least a portion of the receiver member.

16. The method according to claim 15, wherein the total fused height of the marking particle and larger sized toner particle stack is at least 100 μm on at least a portion of the receiver member.

17. The method according to claim 13, wherein one or more electrographic process set points for selectively applying first standard size marking particles onto the receiving member by a first print module are different from one or more corresponding electrographic process set points for selectively applying first larger sized marling particles onto the receiving member by a second print module.

18. The method according to claim 13, wherein the first standard size marking particles include pigmented marking particles and the first and second larger sized toner particles are non pigmented non-marking particles.

19. The method according to claim 13, wherein the toner particles for applying at least one of the first raised images and the second raised images are pigmented marking toner particles.

20. The method according to claim 13, further comprising:

selectively applying second standard size marking particles onto the receiving member by a fourth print module, wherein the second standard sized marking particles are applied prior to the selectively applying first larger sized toner particles and the selectively applying second larger sized toner particles.

21. A receiver member having a raised image formed by a process comprising:

forming a print image electrographically on the receiver member using standard sized marking particles;

forming a first raised image electrographically on first selected areas of the print image on the receiver member using first toner particles having a volume average diameter substantially larger in than the standard sized marking particles;

forming a second raised image electrographically on second selected areas of the first raised image and the print image using second toner particles having a volume average diameter substantially larger than the standard sized marking particles; and setting a process parameter for fixing the print image and the raised images to the receiver member to a changed value distinct from a value for fixing a print image without the raised images, and fixing the print image and the raised images to the receiver member using a fuser employing the changed parameter value.

22. The receiver member according to claim 21, wherein the first toner particles for forming the first raised image have a volume average diameter substantially larger than a volume average diameter of the second toner particles for printing the second raised image.

23. The receiver member according to claim 21, wherein the first toner particles for applying the first raised image and the second toner particles for applying the second raised image are non-marking particles.

24. The receiver member according to claim 21, wherein the first selected areas and the second selected areas overlap the print image on a portion of the receiver member, and wherein the total fused height of a marking particle and larger sized toner particle stack is at least 40 μm on the portion of the receiver member.

25. The receiver member according to claim 21, wherein the standard size marking particles have a volume average diameter of less than 9 μm, and the toner particles for printing the first raised image and for printing the second raised image have a volume average diameter of greater than 14 μm.

26. The receiver member according to claim 21, wherein the first selected areas and the second selected areas overlap the print image on a portion of the receiver member, and wherein the total fused height of a marking particle and larger sized toner particle stack is at least 100 μm on the portion of the receiver member.

27. The receiver member according to claim 21, wherein forming a print image electrographically on a receiver member comprises forming a print image using a plurality of print modules, wherein each print module applies a pigmented marking particle have a color different from the marking particles applied by the others of the print modules.

28. The receiver member according to claim 21, wherein the toner particles for applying at least one of the first raised images and the second raised images are pigmented marking toner particles.

29. The receiver member according to claim 21, wherein forming a print image electrographically on a receiver member comprises forming a print image using a single print module.

30. The receiver member according to claim 21, wherein one or more electrographic process set points for a print module applying a print image to a receiver member is different from one or more corresponding electrographic process set points for a print module applying the first raised image to the receiver member.

31. The receiver member according to claim 21, wherein an algorithm for generating image information for applying the print image in an area of the receiver member not overlapped by the first raised image or the second raised image is different from an algorithm for generating image information for generating the print image in an area of the receiver member not overlapped by the first raised image and not overlapped by the second raised image.

32. The receiver member according to claim 21, the process further comprising:

forming a third raised image electrographically on third selected areas of the print image on the receiver member using third toner particles having a volume average diameter substantially larger than the volume average diameter of standard sized marking particles.

* * * * *